US005165586A

United States Patent [19]

Unuma

[11] Patent Number: 5,165,586

[45] Date of Patent: Nov. 24, 1992

[54] PAPER FEED APPARATUS EQUIPPED WITH FEED BELT SUPPORTERS

[75] Inventor: Sadao Unuma, Yokonemachi, Japan

[73] Assignees: Tokai Kogyo Kabushiki Kaisha, Aichi; Bando Chemical Industries, Ltd., Kobe, both of Japan; Seits Corp., Torrington, Conn.

[21] Appl. No.: 534,279

[22] Filed: Jun. 7, 1990

[30] Foreign Application Priority Data

Jun. 16, 1989 [JP] Japan ..... 1-154893

[51] Int. Cl.[5] ..... B65H 20/20

[52] U.S. Cl. ..... 226/74; 226/170; 400/616.1

[58] Field of Search ..... 226/74, 75, 170; 400/616.1, 616.2; 474/184; 198/841

[56] References Cited

U.S. PATENT DOCUMENTS

| | | | |
|---|---|---|---|
| 2,179,156 | 11/1939 | Mabon | 226/74 |
| 4,013,167 | 3/1977 | Bourgeois | 198/841 X |
| 4,194,660 | 3/1980 | Seitz | 226/74 |
| 4,206,859 | 6/1983 | Plaza | 226/170 X |
| 4,215,776 | 8/1980 | Esler | 198/841 X |
| 4,413,764 | 11/1983 | Weber et al. | 226/170 |
| 4,421,261 | 12/1983 | Hubbard | 226/170 X |
| 4,697,727 | 10/1987 | Hubbard, II | 226/74 |
| 4,723,697 | 2/1988 | Tano et al. | 226/74 |
| 4,961,526 | 10/1990 | Unuma | 226/74 |
| 5,048,739 | 9/1991 | Unuma et al. | 226/74 |

*Primary Examiner*—Daniel P. Stodola
*Assistant Examiner*—Paul Bowen
*Attorney, Agent, or Firm*—Wenderoth, Lind & Ponack

[57] ABSTRACT

A paper feed apparatus including a pair of side frames connected together so as to face one another with a predetermined gap therebetween, an endless feed belt mounted between the pair of side frames, a driving sprocket engaged with the endless feed belt and mounted between the pair of side frames at a first end thereof, and a belt receiver mounted between the pair of side frames at a second end thereof and supporting the endless feed belt. The driving sprocket and belt receiver have the endless feed belt trained thereabout with a predetermined amount of slack, such that the upper and lower runs of the belt are substantially linear. A feed belt supporter is mounted to the pair of side frames so as to contact an outer surface of and support the lower run of the endless feed belt so as to prevent the predetermined slack from gathering at the lower run of the endless feed belt.

12 Claims, 6 Drawing Sheets

PAPER FEED APPARATUS EQUIPPED WITH FEED BELT SUPPORTERS

BACKGROUND OF THE INVENTION

This invention relates to a paper feed apparatus equipped with feed belt supporters which reduces sliding resistance between a feed belt and a belt receiver over which the feed belt is set at the time of travelling of the feed belt and reduces the torque necessary for the rotation of a driving sprocket.

The terms "paper feed side" of the feed belt and "counter paper feed side" used in this specification refer to portions of the feed belt which during travelling, have velocity components in a paper feed direction and in a direction opposite to the former, respectively.

The terms "linear travelling portion" and "curved travelling portion" of the feed belt refer to the portions where the feed belt travels in the linear form (i.e. upper and lower runs of the feed belt) and in the curved (arcuate) form, respectively.

DESCRIPTION OF THE PRIOR ART

The basic construction of a paper feed apparatus comprises a pair of side frames disposed in such a manner as to face each other with a predetermined gap between them, a driving sprocket supported rotatably at one of the end portions of the pair of side frames, a hook member disposed at the other end of the pair of side frames and an endless feed belt disposed between the pair of said frames and set over the driving sprocket and the hook member with a predetermined slack, such that the feed belt can be circulated by rotation of the driving sprocket so as to feed paper.

Hook member which can be used for carrying the feed belt in cooperation with the driving sprocket can be classified broadly into the following two types. The first type has a rotary structure consisting of a rotary member such as a pulley and a sprocket which is supported rotatably between a pair of side frames, and the other type has a fixed structure such as a belt receiver disposed integrally on the side frames.

The paper feed apparatus shown in FIGS. 14 and 15 uses a belt receiver 33 disposed integrally with the side frames 35 as the hook member for carrying an endless feed belt 32 in cooperation with the driving sprocket 31.

The endless feed belt 32 is arranged in a ring-like form as shown in FIG. 13. This feed belt 32 is run by the driving rotation of the driving sprocket 31. In order to reduce as much as possible the rotational torque of the driving sprocket 31 necessary for running the feed belt 32, the feed belt 32 is provided with a predetermined slack when passed around the driving sprocket 32 and the belt receiver 33.

The paper feed side of the feed belt 32 functions as the paper pull side and at the same time, it is pressed by a paper support cover 34 after a sheet of paper is placed on it. Therefore, it is kept substantially horizontal, but its counter paper feed side serves as a slack side, so that the slack of the feed belt 32 gathers at this portion and a swell occurs as shown in FIG. 15. The swell portion of the feed belt vibrates during travelling of the belt and this vibration is propagated up to the linear travelling portion of the feed belt on its paper feed side, thereby causing resonance. As a result, paper feed accuracy drops. When this paper feed apparatus is assembled into equipment such as a printer, it must be assembled with sufficient clearance or space lest this swell portion of the feed belt come into contact with surrounding components. This impedes the reduction of the size of equipment.

If the hook member for carrying the feed belt 32 in cooperation with the driving sprocket 31 is a rotary member such as a pulley or a sprocket, the resistance to travel of the feed belt is the rotary resistance of the rotary member. However, such rotary resistance is low. In contrast, if the hook member is the belt receiver 33 disposed integrally on the side frames 35 such as described above the resistance to travel of the feed belt is the friction between the belt receiver 33 and the feed belt 32 as the feed belt 32 is pulled by the driving sprocket 31 and travels while sliding on the upper surface of the belt receiver 33. Accordingly, the sliding resistance becomes great between the feed belt 32 and the belt receiver 33 and the torque necessary for the rotation of the driving sprocket 31 becomes great.

Since a small motor having a small output is used as the driving motor for rotating this driving sprocket 31, a large load will be applied to the small driving motor if the rotary torque of the driving sprocket 31 is high.

It is a first object of the present invention to reduce the rotary torque of the driving sprocket necessary for driving the feed belt by reducing the sliding resistance between the feed belt and the belt receiver in a paper feed apparatus of the type which uses the belt receiver of the fixed structure as the hook member for carrying the feed belt in cooperation with the driving sprocket.

It is a second object of the present invention to improve paper feed accuracy by preventing the propagation of the vibration resulting from the slack of the feed belt to the linear travelling portion on the paper feed side of the feed belt.

These and other objects and novel advantages and features of the present invention will become more apparent from the following description.

SUMMARY OF THE INVENTION

The present invention is characterized in that feed belt supporters are disposed on the side frames of the paper feed apparatus or on the auxiliary frames fitted to the side frames and are brought into gentle contact with the outside of the feed belt travelling past the linear travelling portion on the counter paper feed side for supporting the feed belt so that the slack of the feed belt occurring at the linear travelling portion on the counter paper feed side is gathered to the curved travelling portion or is dispersed to this curved travelling portion and to the linear travelling portion on the counter paper feed side.

Accordingly, a limited clearance is defined between the arcuate belt receiver as the curved travelling portion and the feed belt travelling past this portion and a winding angle of the feed belt with respect to the belt receiver becomes small, so that the sliding resistance between the belt receiver and the feed belt becomes small. In consequence, the rotary torque of the driving sprocket for driving the feed belt becomes small and the load to the small driving motor for rotating the driving sprocket becomes small.

Since the slack of the feed belt does not gather at the linear travelling portion on the counter paper feed side, vibration does not occur on the feed belt travelling past this portion. Accordingly, this vibration is not transmitted to the linear travelling portion of the feed belt on the paper feed side and paper feed accuracy can be improved.

BRIEF DESCRIPTION OF THE DRAWINGS

FIGS. 1 to 12 are drawings which are useful for explaining the present invention, wherein:

FIG. 1 is a central, longitudinal sectional view of a paper feed apparatus equipped with feed a belt supporter in accordance with the present invention;

FIGS. 2 and 3 are sectional views taken along line II—II and along line III—III of FIG. 1, respectively;

FIG. 4 is a partial perspective view of the paper feed apparatus when viewed from below;

FIG. 5 is an enlarged, partial sectional view taken along line V—V of FIG. 2;

FIG. 6 is a sectional view showing a feed belt supported by another feed belt supporter;

FIG. 7 is a partial perspective view of the paper feed apparatus equipped with still another supporter when viewed from below;

FIG. 8 is a sectional view showing the feed belt 11 supported by the feed belt supporter of FIG. 7;

FIG. 9 is a central, longitudinal sectional view of a paper feed apparatus equipped with yet another feed belt supporter;

FIG. 10 is a sectional view taken along line X—X of FIG. 9;

FIG. 11 is a partial perspective view of the paper feed apparatus when viewed from below; and FIG. 12 is a transverse sectional view of the portion of another feed belt supporter of a paper feed apparatus equipped with auxiliary frames.

FIGS. 13 to 15 are explanatory views useful for explaining a conventional paper feed apparatus, wherein:

FIG. 13 is a front view of a feed belt during shaping;

FIG. 14 is a front view where of a feed belt passed around a driving sprocket and a conventional belt receiver; and FIG. 15 is a front view showing the feed belt with a linear travelling portion on the paper feed side supported by a paper support cover and the slack of the feed belt gathered at the linear travelling portion on the counter feed side.

DESCRIPTION OF THE PREFERRED EMBODIMENTS

Figure 1:
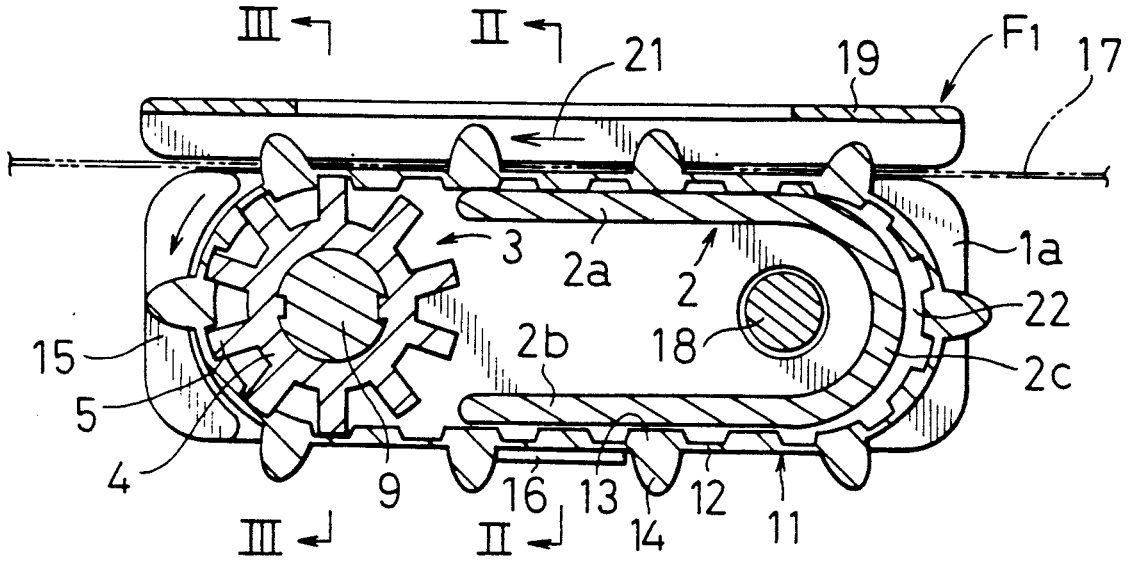

Hereinafter, the present invention will be explained in further detail with reference to embodiments thereof, with a paper feed apparatus disposed either horizontally or substantially horizontally.

FIGS. 1 to 5 show a paper feed apparatus $F_1$ of the first embodiment of the present invention.

A pair of side frames 1*a* and 1*b* are assembled integrally to face each other with a predetermined gap between them, and a belt receiver 2 is integrally disposed on the inside surface of one 1*a* of the side frames. This belt receiver 2 consists of linear portions 2*a* and 2*b* that are disposed horizontally with a predetermined gap between them in a vertical direction, and an arcuate curved portion 2*c*.

A driving sprocket 3 has a large number of outer gear teeth 5 disposed on the outer peripheral surface of a sprocket main body 4 and fitting portions 6 projecting from both of its side surfaces. A sprocket hole 7 is bored at one of the ends of each of the pair of side frames 1*a*, 1*b* and the driving sprocket 3 is disposed between the pair of side frames 1*a*, 1*b* in such a manner that the fitting portions 6 projecting from both side surfaces of the driving sprocket 3 are fitted rotatably into the sprocket holes 7 of the pair of side frames 1*a*, 1*b*. A driving shaft 9 is fitted into a shaft hole bored at the center of the sprocket main body 4.

An endless feed belt 11 has inner gear teeth 13 formed on the inner peripheral surface of the belt main body 12, and also has a large number of feed pins 14 projecting from its outer peripheral surface. This feed belt 11 is set over the driving sprocket 3 and the belt receiver 2 described above. The outer gear teeth 5 and the inner gear teeth 13 of the feed belt 11 mesh with one another along a portion of the driving sprocket 3.

Arcuate wall portions 15 are disposed at the end portions of the inner side surfaces of each side frame 1*a*, 1*b* on the side of the driving sprocket 3 in such a manner as to face each other, and these wall portions prevent the feed belt 11 that travels in a curved path past these portions from moving away by a distance exceeding a predetermined distance in the radial direction of the driving sprocket 3. In this manner the outer gear teeth 5 of the driving sprocket 3 and the inner gear teeth 13 of the feed belt 11 are prevented from becomming disengaged from one another.

Figure 2:
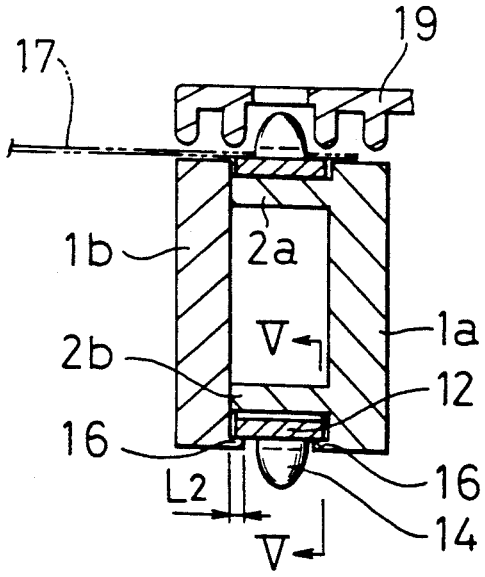
Figure 3:
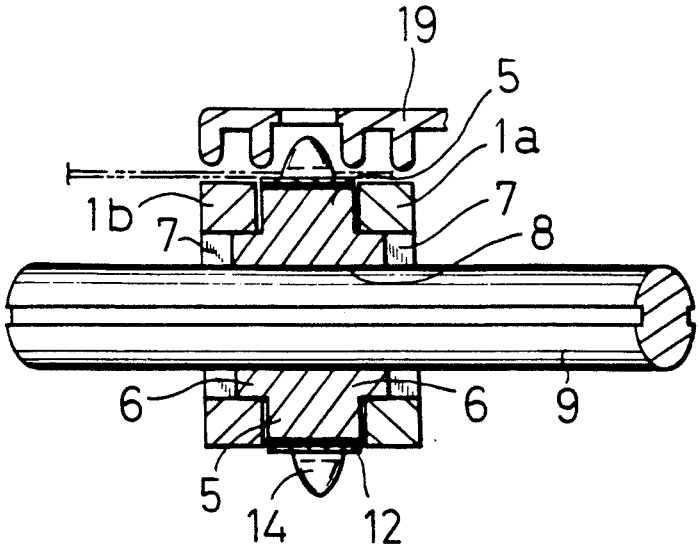
Figure 4:
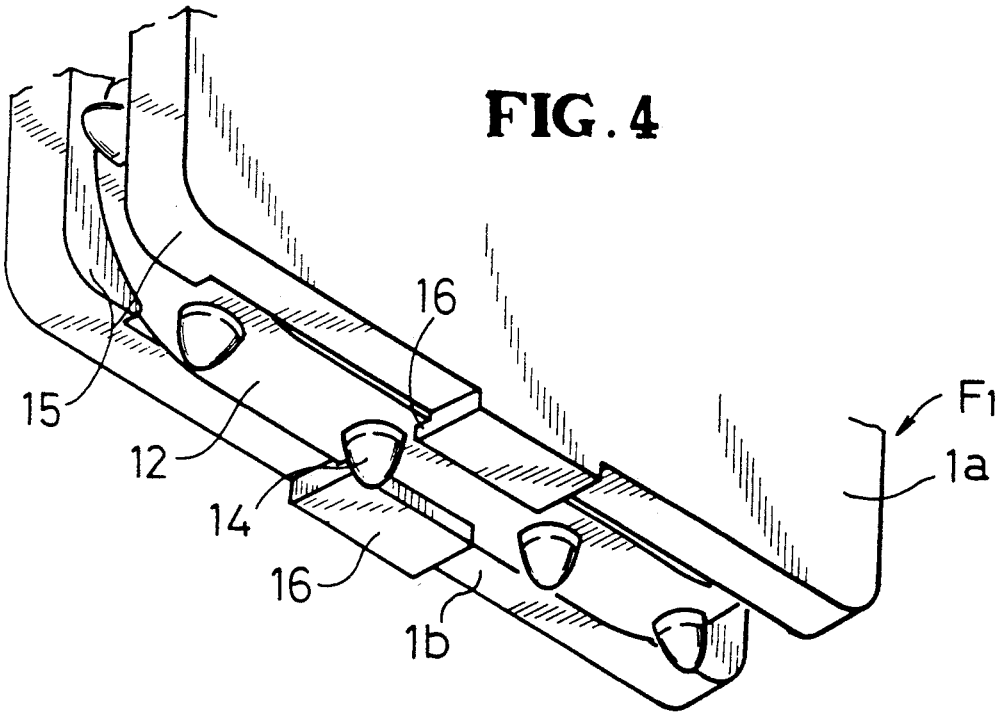
Figure 5:
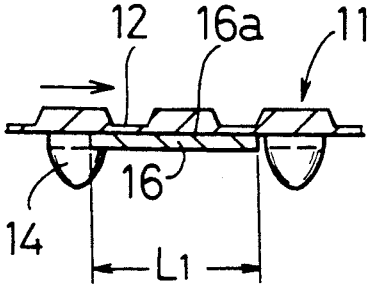

Feed belt supporters 16 are disposed integrally at the centers of the lower end portions of the side frames 1*a*, 1*b*, respectively, in such a manner as to face each other. The length of each feed belt supporter 16 in the travelling direction of the feed belt 11 is $L_1$, and as shown in FIG. 1, is such that the feed belt supporter 16 extends along only a minor portion of the lower run of the belt 11. The projection length of the feed belt supporter 16 from the inner side surface of each side frame 1*a*, 1*b* is $L_2$. The projection length ($L_2$) of each feed belt supporter 16 from the inner side surface of each side frame 1*a*, 1*b* is determined so as not to come into contact with the feed pin 14 of the feed belt 11. As shown in FIGS. 2 and 4, the belt main body 12 of the feed belt 11 travelling the linear travelling portion on the counter paper feed side is supported by the support surface 16*a* of the feed belt supporter 16 and travels while keeping a gentle contact with it.

Incidentally, reference numeral 17 in the drawings represents paper; 18 represents a support shaft for mounting a pair of paper feed apparatus $F_1$ with a gap therebetween corresponding to the width of the paper 17; and 19 represents a paper support cover.

The feed belt 11 is caused to travel in the direction represented by arrow 21 by the rotation of the driving sprocket 3, and paper 17 is delivered by the feed belt 11 that travels past the linear travelling portion on the paper feed side.

Here, the feed belt supporter 16 is disposed integrally at the lower end portion of each side frame 1*a*, 1*b*, the feed belt 11 travelling past the linear travelling portion on the counter paper feed side comes into gentle contact with the belt supporter 16 both of its end portions in the transverse direction of the belt main body 12 and it is supported from below (from outside the feed belt 11) by the length ($L_1$) in the travelling direction of the feed belt 11 and is lifted up. Accordingly, if the feed belt supporter 16 is not utilized, the slack of the feed belt 11 gathers at the linear travelling portion on the counter paper feed side and swell occurs in the feed belt travelling past this portion. Due to the function of the feed belt supporter 16 described above, however, the slack of the feed belt 11 either gathers at the curved travelling portion on the side of the belt receiver 2 or is dispersed to this curved travelling portion and to the linear travelling portion on the counter paper feed side.

As a result, a limited clearance 22 is defined between the outer peripheral surface of the curved portion 2c of the belt receiver 2 and the inner gear teeth 13 of the feed belt 11 travelling past this portion, and the winding angle of the feed belt 11 about the curved portion 2c of the belt receiver 2 is reduced, so that the sliding resistance between the belt receiver 2 and the feed belt 11 is also reduced. In other words, the rotary torque of the driving sprocket 3 necessary for driving the feed belt 11 is reduced. Since the slack of the feed belt 11 does not gather at the linear travelling portion on the counter paper feed side, vibration does not occur in the feed belt 11 travelling past this portion. As a result, no vibration is transmitted to the feed belt 11 travelling past the linear travelling portion on the paper feed side and therefore resonance does not occur, and eventually, paper feed accuracy can be improved.

Further, the present apparatus is free from a large swell of the feed belt 11 travelling past the linear travelling portion on the counter paper feed side, unlike the conventional paper feed apparatuses. Accordingly, it is not necessary to provide a space for avoiding interference with surrounding components when the apparatus is assembled in equipment such as a printer. Therefore, the equipment can be more compact.

Figure 6:
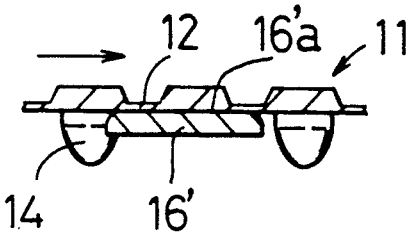
Figure 7:
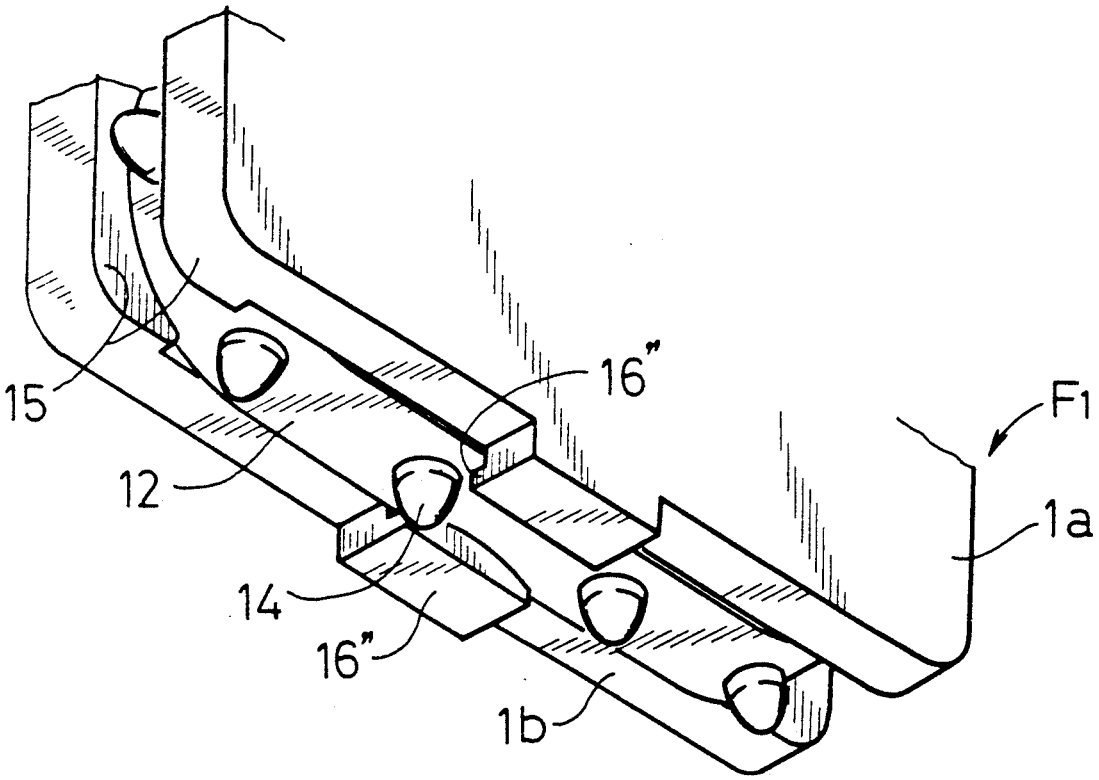
Figure 8:
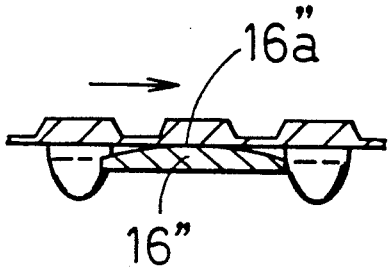

In the feed belt supporter 16' shown in FIG. 6, both of its end portions along the travelling direction of the feed belt on its support surface 16'a are curved so as to make smooth the contact with the feed belt. Further, in the feed belt supporter 16'' shown in FIGS. 7 and 8, the support surface 16''a is itself curved so as to reduce the contact area with the belt main body 12.

Figure 9:
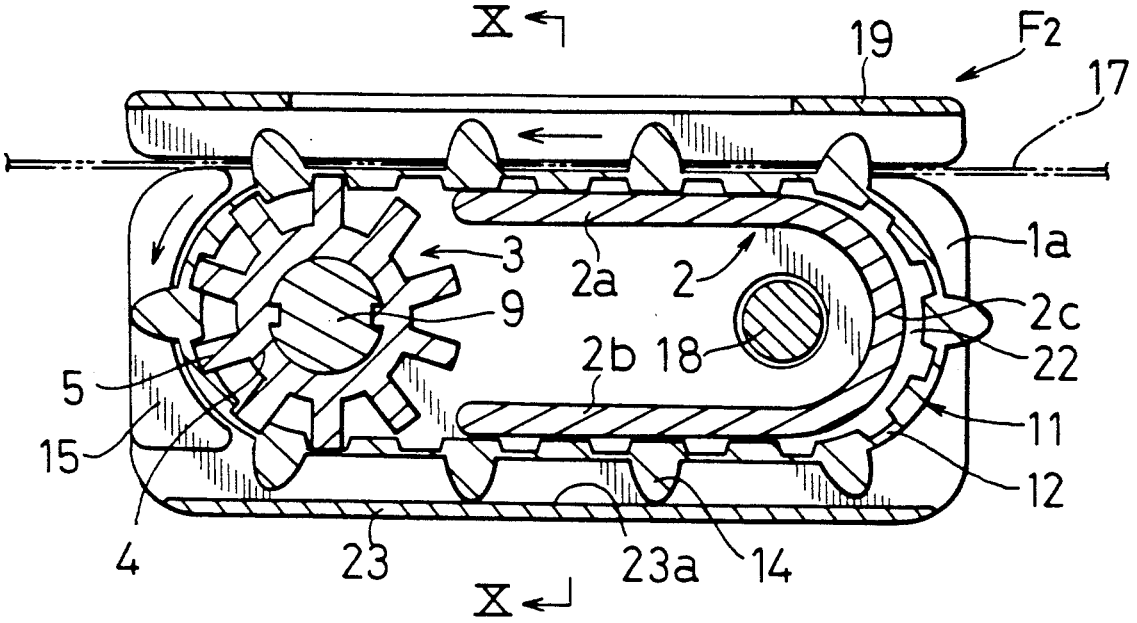
Figure 10:
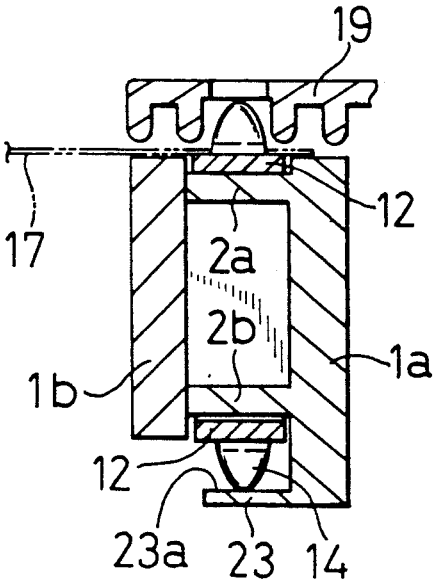
Figure 11:
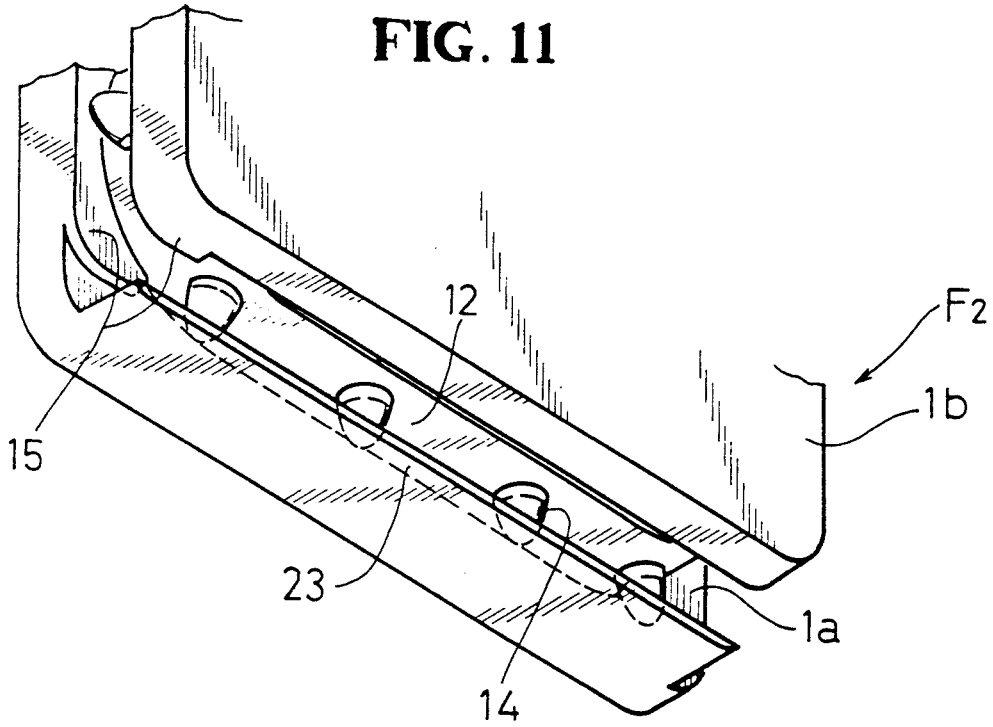

FIGS. 9 to 11 show a paper feed apparatus $F_2$ in accordance with the second embodiment of the present invention.

All of the feed belt supporters 16, 16', 16'' which can be utilized in the paper feed apparatus $F_1$ of the first embodiment have a structure wherein the linear travelling portion on the counter paper feed side is brought into contact with the belt main body 12 of the travelling feed belt 11 and this portion is lifted up from below, but the feed belt supporter 23 of the paper feed apparatus $F_2$ of the second embodiment has a structure wherein the feed belt 11 is lifted up from below by bringing the linear travelling portion on the counter paper feed side into contact with the tips of the feed pins 14 of the feed belt 11.

In other words, a sheet-like feed belt supporter 23 is disposed horizontally at the lower end portion of one 1a of the side frames to project inwardly over the full length in the longitudinal direction. Accordingly, the feed belt 11 travels while the tips of the feed pins 14 of the feed belt 11 travelling past the linear travelling portion on the counter paper feed side are in gentle contact with the support surface 23a on the upper surface of the sheet-like feed belt supporter 23. Therefore, the slack of the feed belt 11 gathers at the curved travelling portion of the portion of the belt receiver 2 and a limited clearance is formed between the outer peripheral surface of the curved portion 2c of the belt receiver 2 and the inner gear teeth 13 of the feed belt 11 travelling past this portion, so that the winding angle of the feed belt 11 to the curved portion 2c of the belt receiver 2 is reduced and the sliding resistance between the belt receiver 2 and the feed belt 11 is also reduced.

Figure 12:
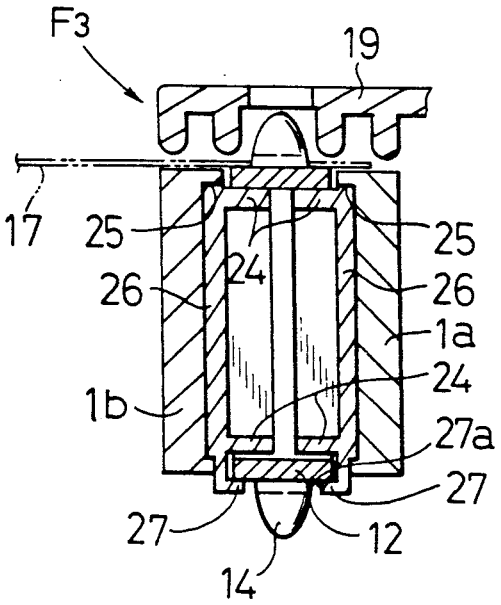
Figure 13:
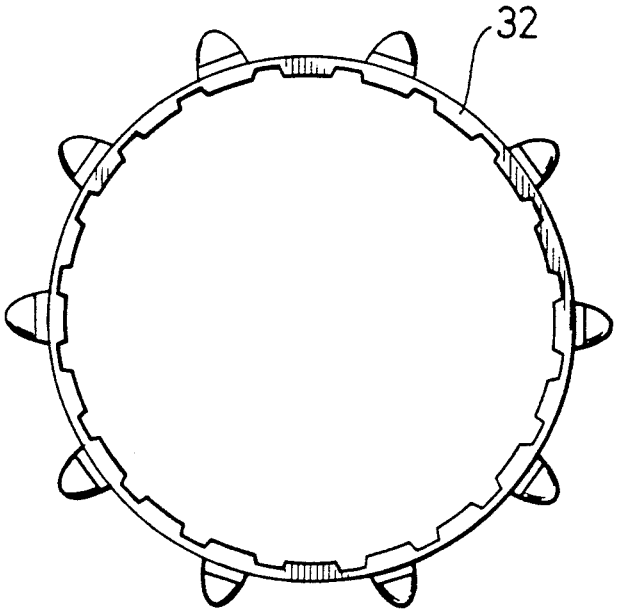
Figure 14:
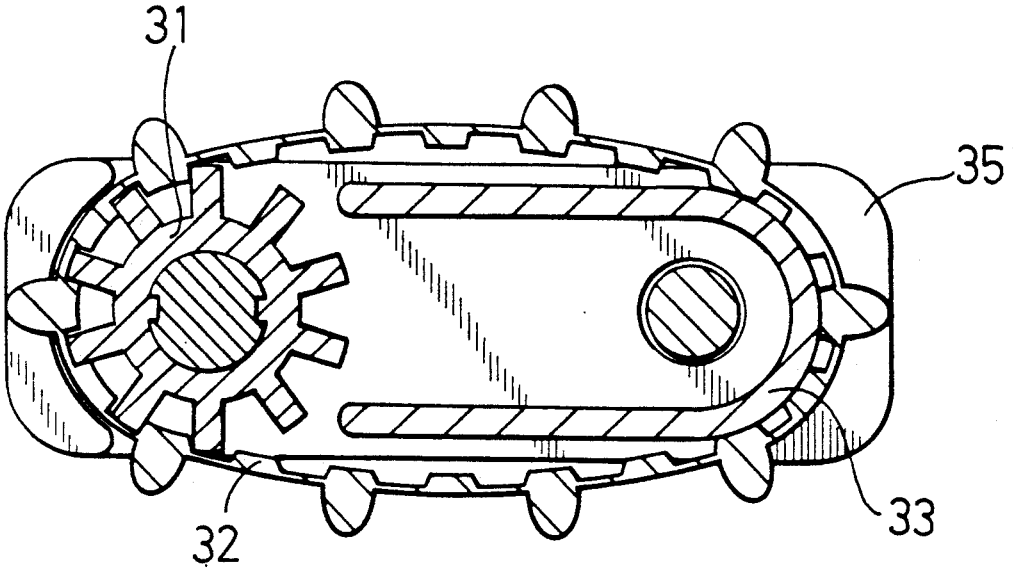
Figure 15:
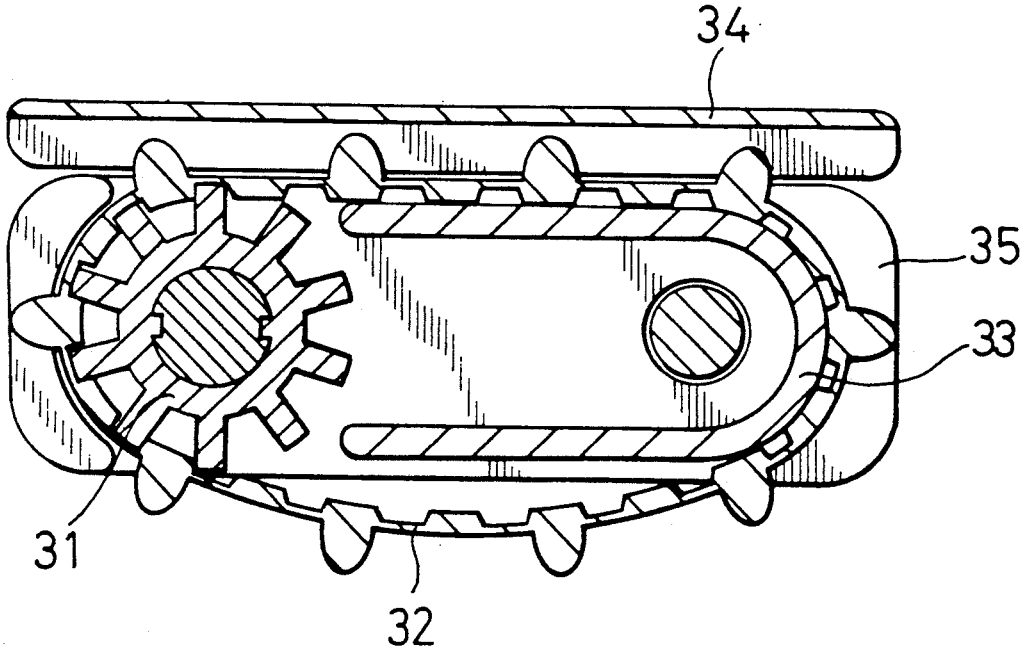

In the paper feed apparatus $F_3$ of the third embodiment of the present invention shown in FIG. 12, a belt receiver 24 for carrying the feed belt 11 in cooperation with the driving sprocket 3 is a separate member from the side frames 1a, 1b.

In other words, an auxiliary frame 26 is fitted into an auxiliary frame groove 25 disposed on the inside surface of each side frame 1a, 1b in such a manner as to be capable of moving finely in the paper feeding direction and the belt receiver 24 is integrally mounted on this auxiliary frame 26. Further, the driving sprocket 3 is supported rotatably, and both the belt receiver 24 and the driving sprocket 3 can move finely in the paper feeding direction integrally with each other. Accordingly, the center distance between the driving sprocket 3 and the curved portion of the belt receiver 24 does not change and paper feed accuracy is high.

In the paper feed apparatus $F_3$ having the structure such as described above, the belt supporter 27 is disposed integrally at the lower end portion of each auxiliary frame 26 so as to project inwardly. The belt main body 12 of the feed belt 11 travelling past the linear travelling portion on the counter paper feed side is supported from below by this feed belt supporter 27 and the feed belt 11 is in gentle contact with the support surface 27a and is lifted up.

In all the foregoing embodiments, the feed belt supporters 16, 23, 27 are disposed integrally on the side frames 1a, 1b or the auxiliary frames 26 but it is possible to employ the structure wherein a belt supporter having a separate structure is fitted to each side frame 1a, 1b.

Furthermore, the foregoing embodiments deal with the case where the paper feed apparatus is used when disposed either horizontally or substantially horizontally. In the cases where the paper feed apparatus is used while being inclined greatly or in a vertical or approximately vertical state, the slack of the feed belt can be dispersed to the portion of the curved travelling portion by bringing the belt supporters into contact with the outside of the feed belt travelling the linear travelling portion on the counter paper feed side and supporting this feed belt. In this manner, the sliding resistance between the curved portion of the belt receiver and the feed belt travelling past this portion can be reduced.

What is claimed is:

1. A paper feed apparatus comprising:

a pair of side frames connected together so as to face one another with a predetermined gap therebetween;

an endless feed belt mounted between said pair of side frames;

means for rotatably mounting said endless feed belt between said pair of side frames with a predetermined slack such that said endless feed belt has a substantially linear upper run, a substantially linear lower run, and a pair of curved portions between said upper run and said lower run, said mounting means comprising a driving sprocket engaged with said endless feed belt at one of said pair of curved portions thereof and rotatably mounted between said pair of side frames at a first end thereof, and a belt receiver mounted between said pair of side frames at a second end thereof and supporting said endless feed belt at the other of said pair of curved portions thereof; and a feed belt supporting means, mounted to said pair of side frames, for contacting an outer surface of and supporting said lower run of said endless feed belt, for dispersing said predetermined slack of said endless feed belt away from said lower run thereof and toward said one of said pair of curved portions thereof, and for preventing vibration of said lower run of said endless feed belt.

2. A paper feed apparatus as recited in claim 1, wherein said endless feed belt includes a main body and a plurality of feed pins projecting outwardly from said main body; and said endless feed belt supporting means is operable to contact said endless feed belt at only said main body thereof, so as to avoid contact with said feed pins thereof.

3. A paper feed apparatus as recited in claim 2, wherein said endless feed belt supporting means comprises a pair of endless feed belt supporter members, each of which is mounted to a respective one of said pair of side frames, extends inwardly toward the other of said pair of endless feed belt supporter members, and underlies said main body of said endless feed belt at said lower run thereof.

4. A paper feed apparatus as recited in claim 3, wherein each of said pair of endless feed belt supporter members has an upper surface which is curved downwardly towards respective ends thereof along a longitudinal direction of said lower run of said endless feed belt.

5. A paper feed apparatus as recited in claim 3, wherein each of said pair of endless feed belt supporter members has respective ends thereof, along a longitudinal direction of said lower run of said endless feed belt, rounded off at upper corners thereof.

6. A paper feed apparatus as recited in claim 1, wherein said endless belt includes a main body and a plurality of feed pins projecting outwardly from said main body; and said endless feed belt supporting means is operable to contact said endless feed belt at only tip ends of said plurality of feed pins thereof.

7. A paper feed apparatus as recited in claim 6, wherein said endless feed belt supporting means comprises a single endless feed belt supporter member mounted to and extending inwardly from one of said pair of side frames toward the other of said pair of side frames, and underlies said plurality of feed pins of said endless feed belt along at least a portion of said lower run thereof.

8. A paper feed apparatus as recited in claim 7, wherein said single endless feed belt supporter member underlies said plurality of feed pins of said endless feed belt along substantially an entire length of said lower run of said endless feed belt.

9. A paper feed apparatus as recited in claim 1, further comprising an auxiliary frame mounted between said pair of side frames, said end feed belt supporting means being fixed to said auxiliary frame.

10. A paper feed apparatus as recited in claim 1, wherein said feed belt supporting means is disposed beneath said lower run of said endless feed belt longitudinally along only a minor portion of said lower run.

11. A paper feed apparatus as recited in claim 1, wherein said endless feed belt includes a main body and a plurality of feed pins projecting outwardly from said main body; and said feed belt supporting means comprises a pair of feed belt supporter members, each of which is mounted to a respective one of said pair of side frames, underlies said main body of said endless feed belt, and extends from said respective one of said pair of side frames inwardly toward the other of said pair of feed belt supporters to such an extent that it avoids contact with said plurality of feed pins.

12. A paper feed apparatus as recited in claim 11, wherein said pair of feed belt supporter members extends longitudinally along only a minor portion of said lower run of said endless feed belt.

* * * * *